US011034476B1

(12) United States Patent
Joshi et al.

(10) Patent No.: US 11,034,476 B1
(45) Date of Patent: Jun. 15, 2021

(54) HIGH SURFACE AREA BENEFICIAL CONTAINER

(71) Applicant: Microlin, LLC, Salt Lake City, UT (US)

(72) Inventors: Ashok V. Joshi, Salt Lake City, UT (US); Radha A. Joshi, Bellevue, WA (US)

(73) Assignee: Microlin, LLC, Salt Lake City, UT (US)

( * ) Notice: Subject to any disclaimer, the term of this patent is extended or adjusted under 35 U.S.C. 154(b) by 358 days.

(21) Appl. No.: 15/978,164

(22) Filed: May 13, 2018

Related U.S. Application Data

(60) Provisional application No. 62/505,883, filed on May 13, 2017.

(51) Int. Cl.

| | |
|---|---|
| ***B65B 55/00*** | (2006.01) |
| ***B65D 5/56*** | (2006.01) |
| ***B65D 81/38*** | (2006.01) |
| *B65D 85/34* | (2006.01) |

(52) U.S. Cl.
CPC ..... *B65B 55/00* (2013.01); *B65D 5/56* (2013.01); *B65D 81/3825* (2013.01); *B65D 85/34* (2013.01)

(58) Field of Classification Search
CPC ..... B65B 55/00; B65D 5/56; B65D 51/18; B65D 81/24; B65D 81/26; B65D 81/28; B65D 81/38; B65D 81/3825; B65D 85/34; A23B 7/157
USPC ..... 206/204, 205; 426/118, 124
See application file for complete search history.

(56) References Cited

U.S. PATENT DOCUMENTS

| | | | | |
|---|---|---|---|---|
| 1,481,971 A * | 1/1924 | Whiting | B65D 81/267 206/204 |
| 6,135,273 A * | 10/2000 | Cuen | B65D 81/264 206/204 |
| 6,740,378 B1 * | 5/2004 | Rule | B65D 1/0215 428/35.9 |
| 7,387,205 B1 * | 6/2008 | Wilson | B65D 81/24 206/204 |
| 8,569,407 B2 * | 10/2013 | Leung | B65D 65/466 524/174 |

(Continued)

FOREIGN PATENT DOCUMENTS

DE 202016004013 U1 * 10/2017 ..... F25D 3/08

*Primary Examiner* — Bryon P Gehman
(74) *Attorney, Agent, or Firm* — Brian C. Trask

(57) ABSTRACT

A container to hold a quantity of high surface area material. High surface area material has a surface area of greater than about 20 $m^2/g$. The container may be structured in various ways to dispose the high surface area material in the vicinity of a local environment to cause a beneficial effect on that environment. The container may include a moisture permeable wall. The high surface area material may adsorb moisture, and contain and/or emit or off-gas one or more active agent. An exemplary beneficial container may be used for one or more of the following: to control moisture; regulate temperature (e.g., provide either heating or cooling from ambient); promote tissue healing in a human by application of a medicine or treatment agent in vapor phase; destroy microbes and/or bacteria; and destroy or sequester a ripening agent associated with a foodstuff.

16 Claims, 3 Drawing Sheets

(56) References Cited

U.S. PATENT DOCUMENTS

| | | | | |
|---|---|---|---|---|
| 2006/0289547 | A1* | 12/2006 | Ewing | F25D 27/00<br>220/592.2 |
| 2009/0041908 | A1* | 2/2009 | Canham | B65D 81/266<br>426/118 |
| 2012/0282376 | A1* | 11/2012 | Crawford | B65D 81/268<br>206/205 |
| 2017/0275076 | A1* | 9/2017 | Edgington | B65D 85/34 |

* cited by examiner

HIGH SURFACE AREA BENEFICIAL CONTAINER

RELATED APPLICATIONS

This application claims the benefit under 35 U.S.C. 119(e) of the filing date of Provisional Application Ser. No. 62/505,883, filed May 13, 2017, for "HIGH SURFACE AREA BENEFICIAL CONTAINER".

BACKGROUND

Field of the Invention

This invention relates to devices structured to produce a beneficial effect. It is particularly directed to embodiments providing a reservoir that includes a high surface area material, with the reservoir being configured and arranged to cause one or more effect on a local environment.

State of the Art

It is known to provide various resealable containers or compartments in which to store perishable items, such as food. Commercially available containers include a variety of nonporous plastic resealable containers. Such plastic containers provide an initial environment in which to store items, but do not provide an inherent and on-going impact on their internally-confined environments.

Certain items like produce, such as tomatoes and lettuce, have a relatively short shelf life, even when stored in a nonporous sealed container under refrigeration. The produce tends to become soggy and/or limp due to an on-going ripening process. The ripening process can be retarded in one aspect by maintaining the humidity or moisture level in the storage compartment at a controlled and desirably low level. Sometimes, one or more paper towel(s) is also placed into the container to mitigate evolved water from the produce. It is easily observed that lettuce, e.g., processed by a spinner to remove water, remains firm and crisp much longer than lettuce that is allowed to retain water droplets on the leaves subsequent to a washing procedure.

Another way to retard ripening is to reduce the presence of a ripening agent, such as ethane. Ethane is naturally emitted by produce, and its presence in a storage compartment enhances and accelerates further ripening of the produce inside that compartment. Another way to retard ripening is to reduce the presence of microbes, bacteria, and/or other spoiling agents in a storage compartment.

Another way to retard spoilage is to provide a source of coldness to create a desirable local low-temperature area around one or more food item. Water-based ice packs and cold packs utilizing substitutes for water are known. Such sources of cold may be charged and/or recharged to a low temperature by placing the pack in a freezer for a period of time. The resulting low temperature cold pack can then be associated with a local environment to cause cooling of that local environment.

It is known to provide therapeutic devices to cause a beneficial effect such as to promote healing or a feeling of wellbeing in a human or animal. Certain known therapeutic devices include sources of cold and of heat. A cold pack that can be used for food storage can sometimes be cross-utilized to provide cooling for a portion of a human, such as to reduce swelling at an injury site. A counterpart therapy may include use of a heat pack to introduce heat to a portion of a human. For example, a heat pack may be applied to warm and relax a back muscle, thereby reducing back pain. Commercially available heat packs may be warmed in various ways, including by chemical reaction, soaking in hot water, and microwave activation.

It would be an improvement to provide devices including a reservoir having a high surface area material confined within the reservoir, with the reservoir being configured and arranged to cause one or more beneficial effect or impact on a local environment due in part to the presence of the high surface area material.

BRIEF SUMMARY OF THE INVENTION

The invention may be embodied as a beneficial container. An exemplary beneficial container defines a first volume, and a quantity of high surface area material is disposed inside the first volume, the high surface area material having a surface area greater than 20 $m^2/g$. The beneficial container is configured and arranged to cause one or more beneficial effect on a local environment, the beneficial effect resulting, at least in part, from presence of the high surface area material in the vicinity of the local environment. In certain embodiments, the high surface area material has a surface area greater than 100 m2/g.

Sometimes, a beneficial container includes a moisture permeable wall to allow moisture from a local deployed environment to be adsorbed into the high surface area material. A beneficial container may be associated with a storage box to define a second volume. In that case, the moisture permeable wall is typically disposed to define a boundary portion of the second volume and to permit transfer of moisture from the second volume to the first volume for adsorption of the moisture into the high surface area material.

Certain embodiments may include a pressure relief valve disposed to vent expanded gas from inside the first volume to permit reconditioning of the high surface area material. A silver and/or copper catalyst may be distributed into the high surface material to destroy, adsorb, or otherwise remove a portion of Ethane from a treatment volume. Some embodiments include a substantially saturating quantity of water preloaded into the high surface area material. Sometimes, an antimicrobial agent may be distributed into the high surface area material.

Embodiments may be used as heat packs, and/or as cold packs. A cold pack may be embodied as a removable lid for a tub or other volume-defining element. As is the case for other embodiments of beneficial containers, a pack may be structured as a portion of an enclosure, or as a drop-in item for association with an enclosure. Exemplary cold packs may be recharged by refreezing the moisture adsorbed into the high surface area material(s). A heat pack can typically be recharged in a commercially available microwave. A beneficial container, including a heat and/or a cold pack, may also include one or more therapeutic or medicinal agent pre-loaded into the high surface area material for emanation of the agent(s) into or onto a space or treatment area.

Certain embodiments are drapeable to conform to a portion of a human body. An adhesive portion may be disposed at a perimeter portion of a drapeable beneficial container to maintain an installed beneficial container at the installed position on a human body. A treatment agent may be carried by the high surface area material to emanate a treatment agent in vapor phase through a moisture permeable ply to cause a medicinal or therapeutic effect on the human body at the treatment site.

One drapeable beneficial container is structured as a bandage including a first ply that is moisture permeable, a second ply that is not moisture permeable, and a quantity of high surface area material disposed to form a thin layer of high surface area material distributed over an area between the first ply and the second ply. The first ply and the second ply may be quilted to urge the high surface area material to remain in a thin planar configuration with the high surface area being distributed over the area.

The invention may be embodied in a method for causing an effect on a local environment. One method includes providing a beneficial container having at least two walls configured and arranged to define a volume, and a quantity of high surface area material disposed inside the volume; and disposing the beneficial container in the vicinity of a local environment so that the high surface area may help to cause the desired effect. Effects within contemplation include causing one or more of: a decrease in temperature of the local environment; an increase in temperature of the local environment; a medical treatment of a human at the local deployed environment; a decrease in moisture content in the local environment; destruction of microbes or bacteria in the local environment; and destruction or sequestering of a ripening agent in or from the local area of deployment of the beneficial container.

BRIEF DESCRIPTION OF THE DRAWINGS

In the drawings, which illustrate what are currently regarded as the best modes for carrying out the invention.

DETAILED DESCRIPTION OF THE ILLUSTRATED EMBODIMENTS

Figure 1:
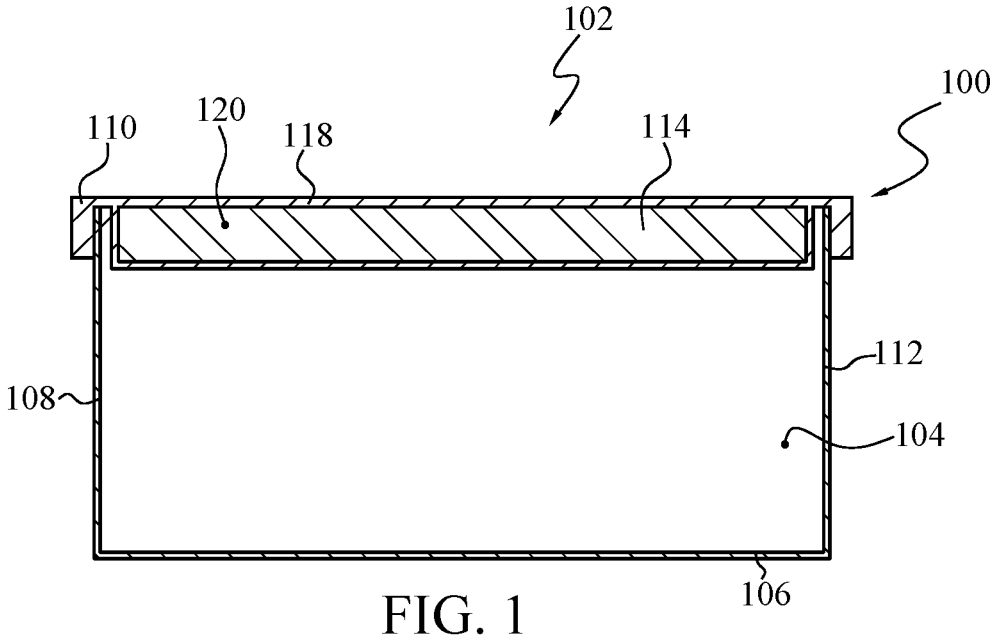
FIG. 1 is a cross-section view in elevation of a device structured according to certain principles of the instant invention.

FIG. 1 illustrates a first currently preferred embodiment of a storage box, generally 100, including a beneficial container, generally indicated at 102 and structured according to certain principles of the instant invention. The illustrated storage box 100 is structured to maintain food in fresh condition for an extended period of time by providing a moisture-controlled storage environment. The box 100 may also be structured to directly provide cooling to the stored items, or may be placed into a cool environment (like a refrigerator or freezer) to cool the items. The storage box 100 may be configured as desired to provide a storage volume 104 in which to hold food, for non-limiting example, and can have a cross-section or planform that is rectangular, circular, or any other desired shape. Typically, the box 100 has a floor 106 and one or more walls 108 that cooperate with a removable lid 110 to define interior storage volume 104.

Figure 2:
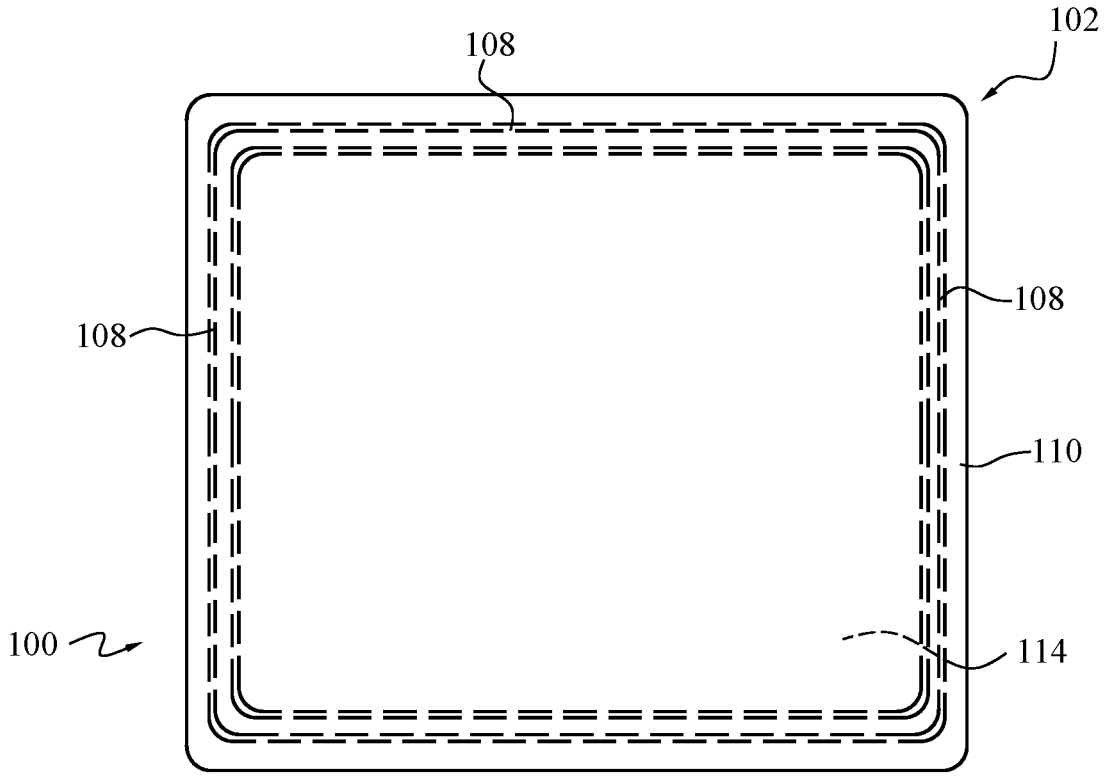
FIG. 2 is a plan view from above of the embodiment in FIG. 1.
Figure 3:
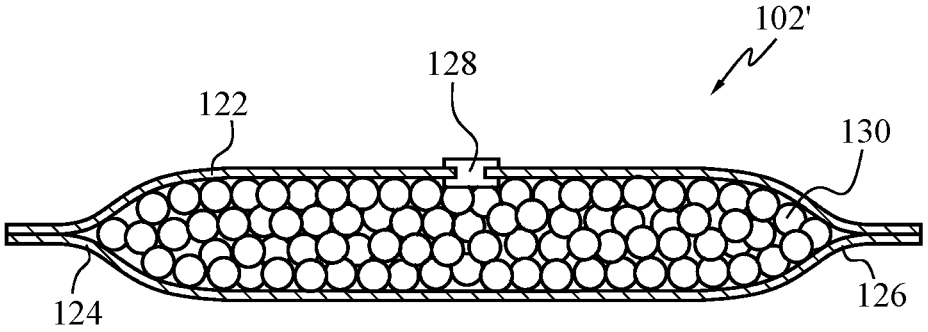
FIG. 3 is a cross-section view of an alternative embodiment.
Figure 4:
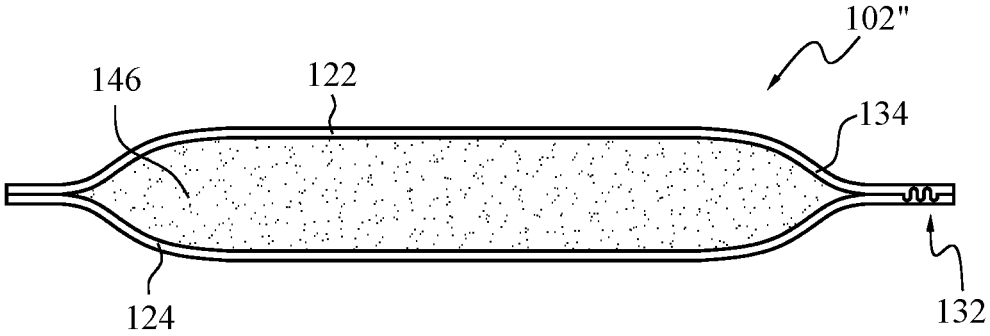
FIG. 4 is a cross-section view of an alternative embodiment.

In the box 100 illustrated in FIGS. 1 and 2, the beneficial container 102 is included as an integral portion of a removable lid 110 of a generally rectangular tub 112. However, it is within contemplation that the container 102 may be formed in other ways, including as an integral component of a wall or floor of a tub 112 (rather than the lid 110), or even as a separate and removable element from the box 100. FIGS. 3 and 4 illustrate certain such separate and removable container embodiments 102' and 102", respectively, within contemplation. It is further within contemplation that a beneficial container 102 may be embodied as a structural element forming all of, or a portion of, a wall and/or lid of a storage box 100.

A workable moisture-controlling beneficial container, such as container 102, is desirably configured to permit moisture from an environment to be adsorbed onto high surface area (HSA) material 114 that is confined inside the container 102. In that case, the container 102 may be used to extract moisture from, and consequently reduce moisture in, a local environment such as volume 104. In FIGS. 1 and 2, moisture from inside the box 100 can be adsorbed onto and/or into HSA material 114 disposed inside the container 102. Consequently, a beneficial moisture-controlling container 102 may be used to cause an effect or impact on a local environment defined inside the box 100. That is, for one non-limiting example, a container 102 may be used to control moisture content or local humidity inside the box 100.

With particular reference to FIG. 1, wall 116 provides a floor of the container 102 and is disposed as a cover over the volume 104. Wall 116 is moisture permeable to permit transfer of moisture through wall 116 from the volume 104. As illustrated, moisture permeable wall 116 is disposed to define a boundary portion of the storage volume 104. Therefore, moisture from volume 104 may easily migrate through the wall 116 to be adsorbed into the HSA material 114.

A workable moisture permeable wall 116 may include holes disposed in an otherwise impermeable wall (e.g., one or more hole(s) in plastic or plastic-like materials), a screen providing gaps or open pores, or a moisture permeable membrane, and the like. Desirably, both of the wall 118 forming the upper or outside surface of the lid 110 and the tub 112 are formed from one or more material(s) that is impermeable to moisture. Therefore, moisture will not propagate into the volume 104 from an external source. That construction ensures that the HSA material 114 acts to control humidity only inside the storage volume 104.

With particular reference to FIG. 1, an exemplary beneficial container 102 is structured to define volume 120 in which hold and confine a quantity of HSA material 114. Workable HSA materials include activated carbon, activated Alumina, activated Titanium oxide, (e.g., activated ceramics), metal/organic high surface area compounds, high surface area Silica, zeolites, molecular sieves, and the like. Such materials may be fabricated and used as powders, granules, beads, chunks, sheets, and/or formed into particular functional structures, and the like. By high surface area, it is intended to mean a material having surface area greater than 20 $m^2/g$. It is generally preferred for HSA materials to be greater than 100, 200, 300, 400, 500, and/or 600 $m^2/g$. HSA materials having surface area of 2,000 or even 10,000 $m^2/g$, or even more, are within contemplation.

Certain preferred reusable container embodiments have walls 116, 118 that are made from high temperature tolerant, food-grade, dishwasher- and microwave-safe materials, such as glass, metals coated with ceramic, plastic (e.g., PEEK (polyetheretherketone)), composites, and the like.

Certain containers 102 are not intended for reuse, and may be manufactured from a wider range of materials that are not heat-resistant.

Containers may be structured to permit their reuse a number of times. Beneficial containers that have been used for moisture control can be quickly recharged or refreshed by heating, microwaving, or applying a vacuum to the HSA material. For example, adsorbed moisture may be removed by application of microwave energy to moisture-loaded HSA material.

As illustrated in FIG. 3, container 102' includes a first wall or ply 122 and a second wall or ply 124. Walls 122, 1214 are bonded together around a perimeter to form a pouch or satchel 126. Typically, at least one of ply 122 and 124 is moisture permeable. Sometimes, a one-way pressure-relief venting valve 128 may be included to permit off-gassed steam to exit a container during a re-conditioning step or process. Sometimes, the entire container 102' may be placed into a microwave for reconditioning the HSA material. In some embodiments, the HSA material may be removed from the container for reconditioning. HSA material may also be reconditioned by heating in an oven or kiln to drive off adsorbed substances.

Certain embodiments of a beneficial container 102 such as a pouch 102' or 102" illustrated in FIGS. 3 and 4, will typically have at least one moisture permeable wall, and may, or may not, include one or more moisture impermeable wall. Further, it is within contemplation that certain embodiments 102 may not include a moisture permeable wall 116 at all. For example, a beneficial container used as an ice pack may include only moisture impermeable walls as an additional safeguard against introducing moisture to an environment as moisture (adsorbed into the high surface area material and then frozen to form the ice pack) thaws.

With reference to FIG. 3, a preferred container 102' includes white ceramic HSA material formed into beads 130 having diameters of perhaps about ¼ inch. A similar bead-form HSA material may be included in container 102 (see FIG. 1). The bottom container floor or layer 116 of container 102 may be formed from a plastic that is molded to define a screen or mesh with apertures too small for the beads 130 to pass through. The apertures promote circulation of moisture into the HSA material for adsorption.

Sometimes, the floor 116 or other part of a container may be removable or openable to permit washing food particles or other contaminants from the beads and/or inside of the container. For example, in FIG. 4, a resealable portion, generally 132, is included at an edge of the pouch 134. Resealable portion 132 includes an interlocking or "zipper-locking" connector such as may be found on a commercially available plastic sandwich bag. Alternative resealable structures are known in the art. Therefore, the beads or other HSA material may be reconditioned while inside, or outside, of a beneficial container.

In an exemplary use of the container illustrated in FIG. 1, food is placed into the storage volume 104, and the lid 110 is sealed onto tub 112 of the storage box 100. The storage box 100 is then typically refrigerated until access to the stored food is desired. Stored food can encompass foods such as produce including lettuce, fruit, vegetables, and the like. Excess moisture is removed from the storage volume 104 during the period of storage, and the removed moisture is adsorbed into the HSA material in the container/lid 110. When reduced efficacy of the container 102 is detected, or perhaps after a proscribed interval of use, the lid 110 is removed and placed into a microwave on high power for a period of time until the adsorbed moisture is off-gassed and the HSA material is reactivated. Typically, a couple or a few minutes are all that is required to refresh or recondition the HSA material, and the storage box 100 is ready for another cycle of use.

Containers such as illustrated in FIGS. 3 and 4 may have any desired plan-form, including round, ovaloid, and rectangular. In an exemplary use of the containers illustrated in FIGS. 3 and 4, a pouch 126, 134 may simply be placed into a storage box or other confined space to control humidity, or to modify or effect some other parameter, in the interior environment of the box or space during a period of storage. Sometimes, the entire storage box may be refrigerated or frozen. When reduced environmental control is detected, or perhaps after a proscribed interval of use, the pouch 126, 134 is removed and placed into a microwave on high power for a period of time until the adsorbed moisture is off-gassed and the HSA material is reactivated. Typically, a couple or a few minutes are all that is required to refresh the HSA material, and the pouch 126, 134 is ready for another cycle of use.

Embodiments structured similar to beneficial containers 102, 102', and 102" may be used as cold packs, and/or as heat packs. In use as a cold pack, water or another freezable fluid is introduced into the HSA material, and then the beneficial container is placed into a cold environment to freeze the adsorbed fluid. Typically, the HSA material is at least substantially saturated with fluid. However, sometimes, care is taken to avoid presence of moisture that can escape from a container when the pack is in a thawed condition. For example, when a container is embodied as a cold pack for a single sandwich, it is undesirable to permit moisture from a thawed pack to enter the sandwich.

In use as a heat pack, moisture adsorbed into the HSA material may be heated (e.g., by microwave), consequently heating the HSA material. HSA material may also be heated by immersion in hot water, soaking at elevated temperature in an oven, and the like. The heated HSA material may then be used as a carrier of heat for application to cause a therapeutic warming effect, sooth muscles, and the like.

Figure 5:
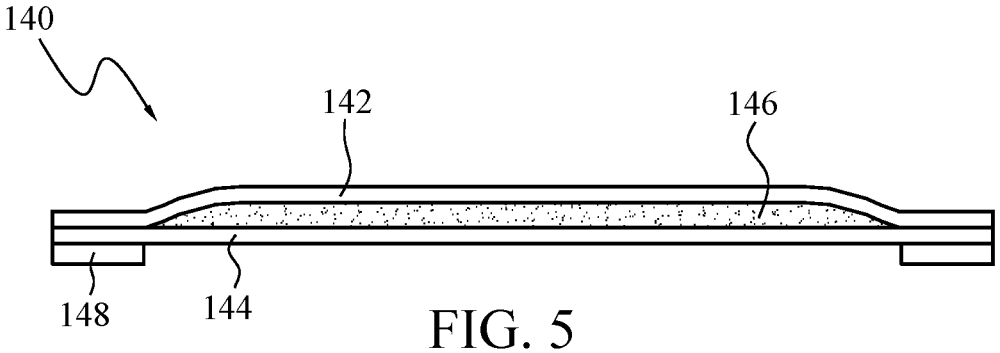
FIG. 5 is a cross-section view of an alternative embodiment structured for wound therapy.

The embodiment indicated generally at 140 in FIG. 5 provides a drapeable bandage that may be applied to a wound or burn, for non-limiting examples. Generally, such bandage-like devices 140 are not structured for re-use. The container 140 may be formed as a relatively thin composite device including top ply 142, bottom ply 144, and a thin layer of high surface area material 146 distributed over an area between the first ply 142 and the second ply 144. The first ply and the second ply of bandage 140 may sometimes be quilted to keep powdered or granular HSA material 146 distributed in a desired arrangement. For example, quilting may be configured to urge the high surface area material to remain in a thin planar configuration with the high surface area material being distributed over an area between the plies. For purpose of this disclosure, "thin" is defined as less than about ¼ inch in thickness.

A moisture permeable ply 144 is typically structured to permit its disposition in proximity to, or in direct contact with, a wound or other area in need of treatment or protection. Sometimes, a bandage/container device 140 may be used in combination with additional spacer materials, such as gauze, to avoid direct contact with a surface to be treated.

Certain embodiments 140 may include an adhesive element 148 disposed at a perimeter of the container to facilitate placement of the container 140 in association with the treatment site. Desirably, the top or exposed surface of ply 142 is made from a moisture-resistant material to provide a dry surface for contact by the patient, and to resist propagation of contaminants into, or out from, the treatment site.

However, it is within contemplation that the container 140 may be provided as e.g., a stand-alone packet disposed inside a separate water-resistant cover element.

It is further within contemplation to structure a container 140 for delivery of a drug or therapeutic agent from HSA material in vapor form. For example, one or more drug or other medical agent may be introduced by a beneficial container to a site to facilitate healing of tissue wounds in a human. Operable medical agents include tissue-healing agents, antifungal agents, acne medicine, and the like. Certain embodiments 140 may place antimicrobial or antibacterial catalysts or agents in operable proximity to the wound.

Certain beneficial containers may be structured to release one or more beneficial agent responsive to adsorption of moisture onto the HSA material carried in that container. For non-limiting example: a catalyst such as catalytic Copper or Silver may be embedded into the HSA material as an antimicrobial catalyst and/or to disassociate ethylene gas, or to accomplish some other beneficial effect. One way to impregnate the HSA material with a catalyst is placing the HSA material into a solution of Silver or Copper Nitrate ($AgNO_3$ or $CuNO_3$), to adsorb the solution onto the HSA material. The metal-loaded HSA material is then placed in a heated environment (e.g., 300° C.) for perhaps ½ to 4 hours to leave behind nano-particles of the metal distributed over the surface area of the HSA material. The resulting impregnated HSA material may find exemplary use to reduce the "ripening hormone" ethylene gas and thereby extend freshness of a stored food item.

HSA materials can be infiltrated with various useful elements or compounds to accomplish desired effects. For example, enhanced beneficial results may be obtained by infiltrating the HAS material with oxygen grabber(s), ethylene destroyer(s), absorbers, and the like. Other beneficial agents may be disposed on, or infiltrated into, HSA materials to e.g., apply a drug, pain medication, anti-microbial agent, antibiotic, anti-inflammatory medicine, Oxygen, or other beneficial treatment product or agent to an area associated with a container in-use.

Many HSA materials adsorb Nitrogen, Oxygen, and moisture from the local atmosphere. When the local atmosphere is confined inside a storage box having a defined volume, the HSA material can actually reduce the pressure (e.g. create a partial vacuum) inside the box. As an example, certain zeolites (Alumina-Silicates) adsorb large amounts of Nitrogen, which can act to reduce local pressure inside a storage box. Similarly, ZSM5 (a molecular sieve) is known to adsorb ethylene.

The above-disclosed HSA materials, and mixtures thereof, may be used to adsorb ethylene, moisture, other gases including Nitrogen, Oxygen, etc., to create a healthy antimicrobial environment in a storage box to extend the storage shelf life of, e.g., produce including salad, fruit, and vegetables. HSA materials can also be incorporated with Oxygen grabbers like Perovskite ceramic materials including lanthanum strontium manganite (LSM), and lanthanum strontium cobaltite. Such materials become Oxygen-deficient when heated during conditioning or reconditioning, and adsorb Oxygen during use in food storage conditions.

Figure 6:
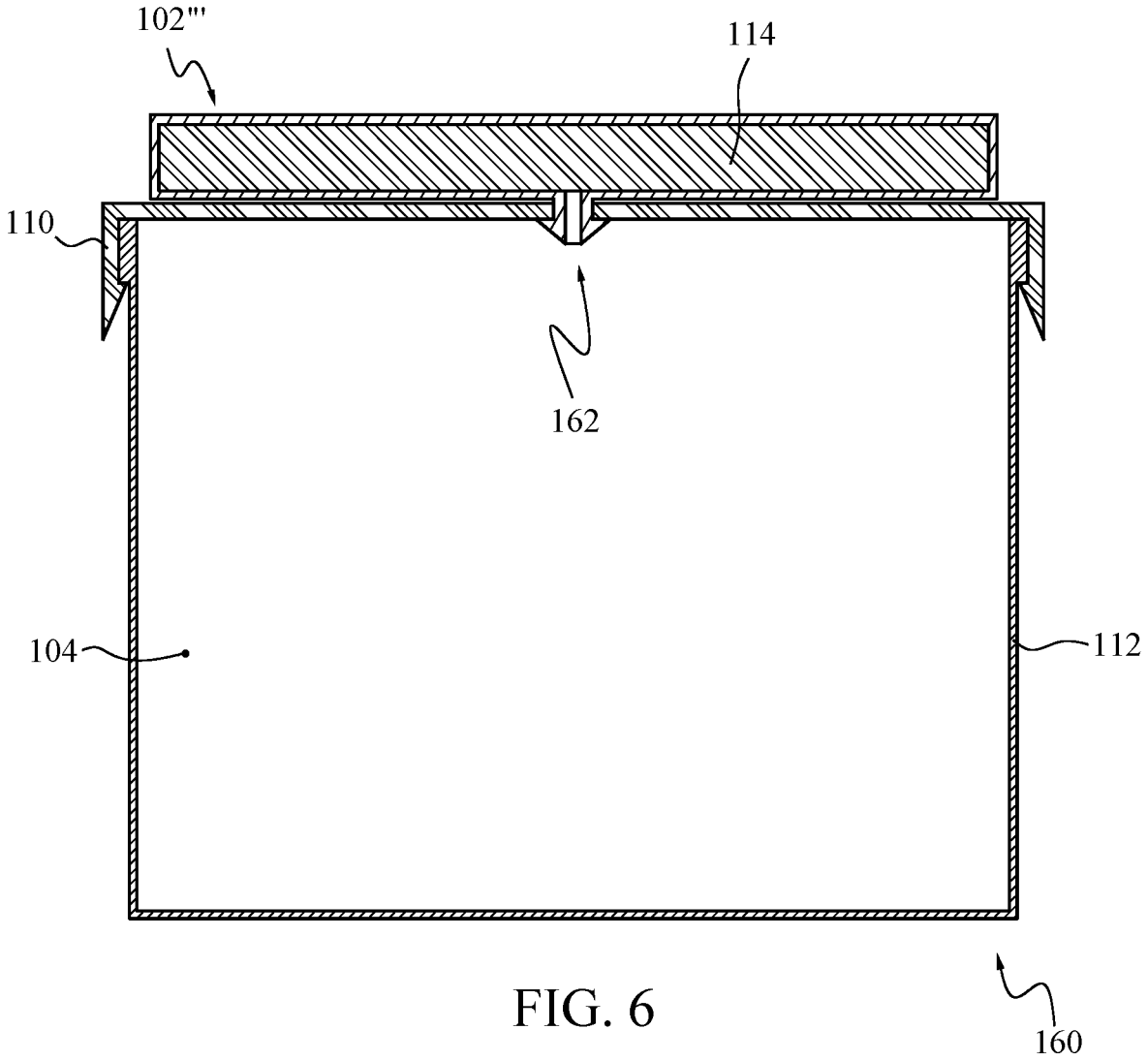
FIG. 6 is a cross-section view of a storage box including an alternative lid embodiment.

As illustrated in FIG. 6, a storage box 160 may be embodied as an assembly including a removable container 102'''. The illustrated container 102''' can be plugged into engagement with a removable or fixed lid 110 to place the environment inside the storage box in communication through an opening 162 with the beneficial HSA material 114 housed in the container 102'''. Structure to effect coupling a container 102''' to a lid 110 may be embodied to form either a permanent or a removable connection. In preferred embodiments, the container 102''' is made from heat-resistant material to permit recharging the HSA material 114 by way of microwaving.

Beneficial containers according to certain principles of the invention may be manufactured to interface with the entire range of commercially available storage boxes. That is, a beneficial container may be incorporated as a replacement for a component of a storage box, such as a replacement lid, or as the above-described "drop-in" package or pouch, and the like.

While aspects of the invention have been described in particular with reference to certain illustrated embodiments, such is not intended to limit the scope of the invention. The present invention may be embodied in other specific forms without departing from its spirit or essential characteristics. For one example, one or more element may be extracted from one described or illustrated embodiment and used separately or in combination with one or more element extracted from one or more other described or illustrated embodiment(s), or in combination with other known structure. The described embodiments are to be considered as illustrative and not restrictive. Obvious changes within the capability of one of ordinary skill are encompassed within the present invention.

The scope of the invention for which a monopoly position is currently desired is indicated by the appended claims rather than by the foregoing description. All changes which come within the meaning and range of equivalency of the claims are to be embraced within their scope.

What is claimed is:

1. A method for using a beneficial container, the container comprising:

a lid defining a first volume;

a storage box defining a second volume; and a quantity of high surface area material disposed inside the first volume, the high surface area material having a surface area greater than 20 $m^2/g$, wherein:

the beneficial container comprises a material to resist such high temperature as would be required to recharge the high surface area material and is configured and arranged to cause at least one beneficial effect on a local environment, the at least one beneficial effect resulting, at least in part, from presence of the high surface area material in the vicinity of the local environment; and a boundary around the first volume and the second volume is formed from one or more materials that is impermeable to moisture to resist propagation of moisture into the first volume from a source other than the second volume; the method comprising:

deploying the beneficial container to preserve at least one food item for a period of time;

recharging the high surface area material responsive to detection of reduced performance of the beneficial container or expiration of a proscribed period of time; and redeploying the beneficial container to preserve food, wherein:

the step of recharging the high surface area material comprises placing the high surface material into a microwave on high power until adsorbed moisture is off-gassed and the high surface area material is reactivated.

2. The method according to claim 1, wherein: the high surface area material has a surface area greater than 100 m2/g.

3. The method according to claim 2, wherein: the lid comprises a moisture permeable wall disposed between the high surface area material and a portion of the second volume upon assembly of the lid and storage box.

4. The method according to claim 3, wherein: the moisture permeable wall is disposed to define a boundary portion of the second volume and to permit transfer of moisture from the second volume to the first volume for adsorption of the moisture into the high surface area material.

5. The method according to claim 3, further comprising:

a pressure relief valve disposed to vent expanded gas from inside the first volume to permit reconditioning of the high surface area material.

6. The method according to claim 3, further comprising:

antimicrobial agent distributed into the high surface area material.

7. The method according to claim 3, further comprising:

at least one of silver and copper catalyst distributed into the high surface material to destroy, adsorb, or otherwise remove a portion of ethane from a treatment volume.

8. The method according to claim 3, further comprising:

a substantially saturating quantity of water preloaded into the high surface area material.

9. The method according to claim 1, wherein:

the step of recharging the high surface area material comprises placing the lid and high surface material contained therein into the microwave on high power until adsorbed moisture is off-gassed and the high surface area material is reactivated.

10. A method for causing an effect on a local environment, the method comprising:

providing a beneficial container having at least two walls configured and arranged to define a volume, and a quantity of high surface area material disposed inside the volume;

disposing the beneficial container in the vicinity of the local environment so that the high surface area may cause the effect;

removing the beneficial container from its deployed location;

recharging the high surface area material; and redeploying the beneficial container in the vicinity of the local environment, wherein:

the beneficial container comprises a material to resist such high temperature as would be required to recharge the high surface area material, wherein:

the step of recharging the high surface area material comprises placing the high surface material into a microwave on high power until adsorbed moisture is off-gassed and the high surface area material is reactivated.

11. The method according to claim 10, wherein:

the effect comprises causing a decrease in temperature of the local environment.

12. The method according to claim 10, wherein:

the effect comprises causing an increase in temperature of the local environment.

13. The method according to claim 10, wherein:

the effect comprises causing a decrease in moisture content at the local environment.

14. The method according to claim 10, wherein:

the effect comprises causing destruction of microbes or bacteria in the local environment.

15. The method according to claim 10, wherein:

the effect comprises causing destruction or sequestering of a ripening agent in or from the local area.

16. The method according to claim 10, wherein:

the step of recharging the high surface area material comprises placing the lid and high surface material contained therein into the microwave on high power until adsorbed moisture is off-gassed and the high surface area material is reactivated.

* * * * *